US010319358B2

(12) United States Patent
Im et al.

(10) Patent No.: US 10,319,358 B2
(45) Date of Patent: Jun. 11, 2019

(54) ROAD NOISE REDUCTION APPARATUS AND INSTALLATION METHOD THEREFOR

(71) Applicant: Nam Kyun Im, Nonsan-si, Chungcheongnam-do (KR)

(72) Inventors: Nam Kyun Im, Nonsan-si (KR); Chan Im, Nonsan-si (KR)

(73) Assignee: Nam Kyun Im, Chungcheongnam-Do (KR)

( * ) Notice: Subject to any disclaimer, the term of this patent is extended or adjusted under 35 U.S.C. 154(b) by 0 days.

(21) Appl. No.: 15/758,867

(22) PCT Filed: Sep. 8, 2016

(86) PCT No.: PCT/KR2016/010123

§ 371 (c)(1),
(2) Date: Mar. 9, 2018

(87) PCT Pub. No.: WO2017/043901

PCT Pub. Date: Mar. 16, 2017

(65) Prior Publication Data

US 2018/0301132 A1 Oct. 18, 2018

(30) Foreign Application Priority Data

Sep. 11, 2015 (KR) ..... 10-2015-0129030

(51) Int. Cl.

| | |
|---|---|
| ***E01C 9/00*** | (2006.01) |
| ***G10K 11/16*** | (2006.01) |
| ***E01C 1/00*** | (2006.01) |
| ***G10K 11/172*** | (2006.01) |
| *E01C 11/24* | (2006.01) |

(52) U.S. Cl.

CPC ..... *G10K 11/16* (2013.01); *E01C 1/002* (2013.01); *E01C 9/00* (2013.01); *G10K 11/172* (2013.01); *E01C 11/24* (2013.01)

(58) Field of Classification Search

CPC ..... G10K 11/16; G10K 11/172; E01C 11/24; E01C 9/00; E01C 1/002

USPC ..... 404/2, 73, 17, 71, 95

See application file for complete search history.

(56) References Cited

U.S. PATENT DOCUMENTS 3,690,227 A * 9/1972 Welty ..... E01C 3/06 404/2
4,300,721 A * 11/1981 Rich ..... E01C 9/06 104/133
6,746,179 B1 * 6/2004 Kerkhoff ..... A01K 1/0103 404/2
7,264,418 B1 * 9/2007 Houck ..... E01C 11/227 405/43
7,866,911 B2 * 1/2011 Saadi ..... E03F 3/046 138/162
8,240,946 B2 * 8/2012 Applefield ..... E03F 3/046 404/2

(Continued)

*Primary Examiner* — Raymond W Addie
(74) *Attorney, Agent, or Firm* — Charney IP Law LLC; Thomas Finetti

(57) ABSTRACT

A noise reducing roadway includes pipe-shaped bodies having a fitting groove formed toward an inside of one end, a shim protruding outward from the other end and a communication portion formed at a side portion of the body to allow the hollow interior to communicate with the outside environment. A heating wire is provided to prevent ice from filling the pipe-shaped bodies.

2 Claims, 6 Drawing Sheets

(56) References Cited

U.S. PATENT DOCUMENTS

| | | | | |
|---|---|---|---|---|
| 8,469,625 | B2 * | 6/2013 | White | E01C 3/00 404/2 |
| 2011/0083925 | A1 * | 4/2011 | Veen | G10K 11/168 181/296 |
| 2012/0263524 | A1 * | 10/2012 | Wijnant | E01C 1/002 404/2 |
| 2015/0322633 | A1 * | 11/2015 | Scattergood | E01C 19/008 404/2 |

* cited by examiner

ROAD NOISE REDUCTION APPARATUS AND INSTALLATION METHOD THEREFOR

CROSS-REFERENCE TO RELATED APPLICATIONS

This application is a National Stage of International Application No. PCT/KR2016/010123, filed on Sep. 8, 2016, which claims priority to and the benefit of the filing date of KR Patent Application No. 10-2015-0129030, filed on Sep. 11, 2015, the disclosures of each are hereby incorporated by reference herein in their entireties.

DESCRIPTION

Technical Field

The present invention relates to an apparatus for reducing road noise by absorbing frictional sounds produced as wheels of vehicles rub against a road surface when the vehicles pass over a road, and a method of installing the same, and more particularly, to an apparatus for reducing road noise by absorbing frictional sounds, produced as wheels of vehicles rub against a road surface, into pipe-shaped bodies having through-holes formed therein through the through-holes as the plurality of pipe-shaped bodies is buried in a road, and the through-holes are exposed to the road surface.

Background Art

In general, in a residential area located near a road where a traffic volume of vehicles such as automobiles is high, a noise blocking facility such as a soundproof wall is frequently installed beside a road due to a noise pollution problem such as various kinds of noise produced as the vehicles are driven.

However, the soundproof wall used to block the noise has very expensive installation costs, disturbs natural ventilation, and adversely affects the aesthetic appearance around the road. Thus, a road noise blocking apparatus that may be substituted for the soundproof wall is required.

Korean Patent Application Publication No. 10-2004-0005583 entitled "Noise reduction-type safety groove for road", Korean Utility Model No. 20-0378200 entitled "Installation structure for cross drain culvert in widthwise direction of road", Korean Patent Application Publication No. 10-2009-0029322 entitled "Groove structure of road surface having noise reduction structure", and Korean Patent No. 10-1046746 entitled "Low noise double layer pavement composite in which asphalt modifiers are mixed with wasted tire chips or rubber chips, and low noise double layer pavement method" are provided and disclosed as the inventions related to a road noise reducing apparatus for solving the above-described problems.

An invention in which safety grooves are continuously formed on a concrete pavement surface to increase surface friction, thereby securing safety of a vehicle and reducing noise is provided in Korean Patent Application Publication No. 10-2004-0005583 entitled "Noise reduction-type safety groove for road", and an invention in which vibrations are absorbed by an improved steel cover and a noise preventing device so that noise occurring when a vehicle passes may be reduced to the minimum, rain water storing devices are installed on opposite surfaces of a concrete drainage box so that rain water introduced into a drain culvert may be quickly discharged, and a cross drain culvert is installed in a widthwise direction of an improved road so that a culture of the road may be improved is provided in Korean Utility Model No. 20-0378200 entitled "Installation structure for cross drain culvert in widthwise direction of road".

Also, a groove structure of a road surface, which prevents a vehicle from slipping even on a rainy road or a snowy road by reducing noise occurring on a road through a noise attenuating portion having convexities and concavities formed along an inner surface thereof and increasing a braking force, is provided in Korean Patent Application Publication No. 10-2009-0029322 entitled "Groove structure of road surface having noise reduction structure", and an invention in which asphalt modifiers are formed in a pallet type, and the asphalt modifiers are mixed with rubber chips or wasted tire chips to prepare ascon composites, so that low noise on a pavement road is achieved is provided in Korean Patent No. 10-1046746 entitled "Low noise double layer pavement composite in which asphalt modifiers are mixed with wasted tire chips or rubber chips, and low noise double layer pavement method".

However, in the above-described related arts, since an apparatus for reducing noise is located on a road surface, is directly in contact with wheels of vehicles, and is thus damaged, maintenance costs are high. Further, since a noise reducing effect of the apparatus is lower than that of a soundproof wall, costs of additionally installing noise blocking equipment are wasted.

Thus, an apparatus for reducing road noise, which is prevented from being damaged by blocking direct contact with the wheels of the vehicles so that maintenance costs are low and has a noise blocking effect that is similar to or more excellent than the conventional soundproof wall, is required.

DISCLOSURE

Technical Problem

An apparatus for reducing road noise and a method of installing the same according to the present invention correspond to technologies provided to solve the above-described problems of the related art. Further, a problem occurs in that noise pollution near a road becomes worse due to a continuous increase in vehicles, a soundproof wall for blocking noise has a problem in that installation costs are high, natural ventilation is disturbed, and the aesthetic appearance around the road is adversely affected, and a noise blocking facility installed as an alternative means for the soundproof wall has a problem in that an effect thereof is lower than that of the soundproof wall or the noise blocking facility is damaged due to contact with wheels of vehicles. Therefore, an objective of the present invention is to provide a solution to these problems.

Technical Solution

In order to achieve the above objective, provided are an apparatus for reducing road noise, the apparatus including pipe-shaped bodies each having a hollow formed in the corresponding body to pass through a part of one end and a part of the other end of the body, a fitting groove formed toward an inside of the one end, a shim protruding outward from the other end, and a communication portion formed at a side portion of the body to allow the hollow to communicate with the outside, in which the plurality of bodies is connected to each other, and a method of installing an apparatus for reducing road noise, the method including a buried groove forming step of forming a plurality of buried grooves in a direction in which vehicles travel on a road surface at regular intervals, an arranging step of seating the apparatuses on the buried grooves such that distal ends of the communication portions is lower than the road surface, and seating the plurality of bodies on the buried grooves, respectively, while connecting the bodies to each other, an injecting step of inserting fillers into the buried grooves of the arranging step so that the apparatuses for reducing road noise are buried in the buried grooves, and a hardening step of hardening the fillers.

Advantageous Effects

In the apparatus for reducing road noise and the method of installing the same according to the present invention, fiction sounds are absorbed into the apparatus for reducing road noise through a through-hole exposed to a road surface so that road noise is reduced, the apparatus for reducing road noise may be installed with lower costs than installation costs of the conventional soundproof wall so that costs are reduced, a ventilation problem according to installation of the soundproof wall is solved, and the aesthetic appearance around the road is not damaged. Further, the noise is not prevented from spreading but the noise itself is absorbed so that the apparatus may achieve an effect that is similar to or more excellent than the conventional soundproof wall, and the apparatus for reducing road noise is buried at a location that is lower than the road surface so that the apparatus is prevented from being damaged by blocking contact with wheels of vehicles.

MODES OF THE INVENTION

Figure 1:
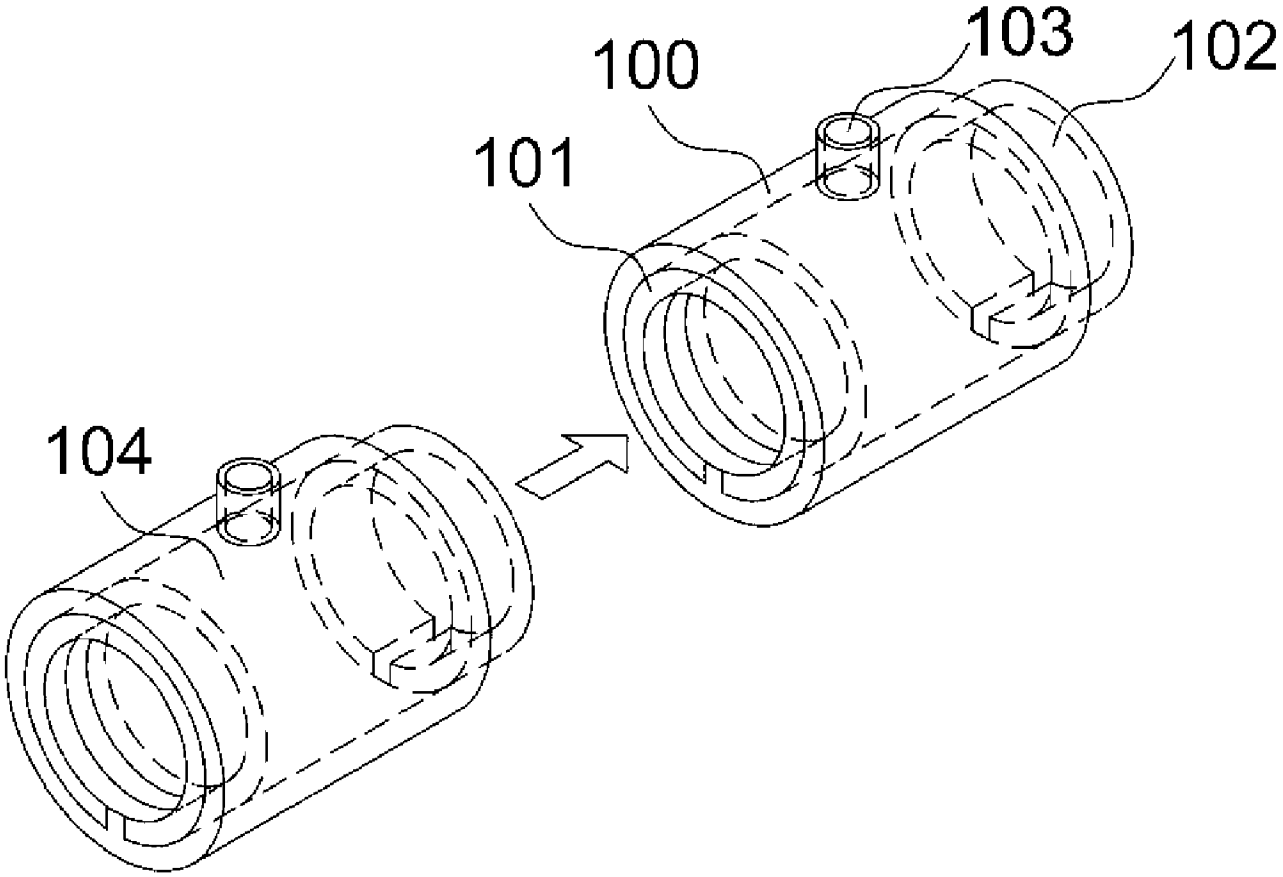
FIG. 1 is a perspective view illustrating a state in which bodies of an apparatus for reducing road noise according to the present invention are connected to each other.

The present invention relates to an apparatus for reducing road noise by absorbing frictional sounds produced as wheels of vehicles rub against a road surface when the vehicles pass over a road, and a method of installing the same, and more particularly, to an apparatus for reducing road noise, which includes pipe-shaped bodies 100 each having a hollow 104 formed therein to pass through a part of one end thereof and a part of the other end thereof, a fitting groove 101 formed toward an inside of the one end, a shim 102 protruding outward from the other end, and a communication portion 103 formed at a side portion thereof to allow the hollow 104 to communicate with the outside, in which the plurality of bodies 100 is connected to each other, and a method of installing the apparatus for reducing road noise, which includes a buried groove forming step of forming a plurality of buried grooves 140 in a direction in which vehicles travel on a road surface at regular intervals, an arranging step of seating the apparatuses for reducing road noise on the buried grooves 140 such that distal ends of the communication portions 103 are lower than the road surface and seating the plurality of bodies 100 on the buried grooves 140, respectively, while connecting the plurality of bodies 100 to each other, an injecting step of injecting fillers 150 into the buried grooves 140 of the arranging step so that the apparatuses for reducing noise road are buried in the buried grooves 140, and a hardening step of hardening the fillers 150.

Hereinafter, embodiments of the apparatus for reducing road noise among the apparatus for reducing road noise and the method of installing the same according to the present invention will be described with reference to the accompanying drawings.

First, the apparatus for reducing road noise according to the present invention includes the pipe-shaped bodies 100 each having the hollow 104 formed therein to pass through the part of the one end thereof and the part of the other end thereof, the fitting groove 101 formed toward the inside of the one end, the shim 102 protruding outward from the other end, and the communication portion 103 formed at the side portion thereof to allow the hollow 104 to communicate with the outside, in which the plurality of bodies 100 is connected to each other.

The fitting groove 101 should be formed at one end of each of the bodies 100, and the shim 102 should be provided at the other end of the body 100. Therefore, considering this fact, the hollow 104 has a diameter at which the hollow 104 passes through only parts of areas of the one end and the other end of the body 100.

The hollow 104 is a space necessary for absorbing noise produced as wheels of vehicles rub against a road surface into the apparatus for reducing road noise according to the present invention, and as the volume of the hollow 104 increases, a noise absorbing effect becomes more excellent.

The fitting groove 101 formed at one end of one body 100 and the shim 102 formed at the other end of another body 100 are fastened and connected to each other to correspond to each other.

The fitting groove 101 and the shim 102 are components necessary for connecting the plurality of bodies 100 to each other, and the apparatus for reducing road noise according to the present invention is configured by connecting the plurality of bodies 100 to each other by inserting the shim 102 provided in the another body 100 among the plurality of bodies 100 into the fitting groove 101 formed at the one body 100.

At this time, only when the fitting groove 101 and the shim 102 configured to connect the bodies 100 to each other are fastened to each other always at the same position and in the same direction only, if the plurality of bodies 100 is connected to each other, the plurality of communication portions 103 is arranged in a row.

The communication portions 103 provided at the side portions of the bodies 100 are passages necessary for absorbing the road noise into the hollows 104.

Although the communication portions 103 may have a cylindrical shape having a diameter of 4 mm to 10 mm, the communication portions 103 may be formed in other shapes as long as the size of the diameter satisfies the range.

When the diameter of the communication portions 103 is smaller than 4 mm to 10 mm, the noise absorbing effect of the apparatus for reducing road noise according to the present invention is lowered, and when the diameter of the communication portions 103 is larger than 4 mm to 10 mm, an amount of foreign matters such as small stones, which are introduced into the apparatus for reducing road noise according to the present invention, increases, and thus a possibility that the hollow 104 is blocked increases.

Thus, the communication portions 103 should have a diameter at which the road noise absorbing effect may be maintained to the maximum and the amount of the introduced foreign matters may be minimized, and in the present invention, the range of the diameter is 4 mm to 10 mm.

An interval between the communication portions 103, which is configured by connecting the plurality of bodies 100 to each other, may be 40±10 mm.

Since the communication portions 103 are formed in the bodies 100, when the plurality of bodies 100 is connected to each other, the plurality of communication portions 103 is arranged at regular intervals.

At this time, since the fitting groove 101 and the shim 102 configured to connect the bodies 100 to each other are fastened to each other always at the same position and in the same direction only, if the plurality of bodies 100 is connected to each other, the plurality of communication portions 103 is arranged in a row.

As the number of the communication portions 103 arranged in a unit area increases, the noise absorbing effect increases. However, at the same time, as the number of the communication portions 103 arranged in a unit area increases, the noise absorbed into the apparatus for reducing road noise according to the present invention is easy to escape to the outside again. Thus, considering the above-described phenomenon, the interval between the communication portions 103 should be formed, and in the present invention, the interval is in a range of 40±10 mm.

Although the communication portions 103 may be provided at the side portions of the bodies 100 integrally with the bodies 100, the communication portions 103 may be provided in a scheme in which the communication portions 103 are coupled to the bodies 100 or are inserted into the bodies 100, and the scheme may be anything.

The scheme in which the communication portions 103 are coupled to the bodies 100 or are inserted into the bodies 100 is for replacing the communication portions 103 when the communication portions 103 are damaged and/or when the communication portions 103 are blocked by foreign matters.

Filtration films such as nets and sifters may be installed distal ends of the communication portions 103 opened to the outside, thereby further reducing the amount of the introduced foreign matters.

Also, heating wires may be provided inside or outside the bodies 100.

Although the bodies 100 may be manufactured of any material such as polyvinyl chloride (PVC) and plastic, it is preferable that the bodies 100 are manufactured of copper alloy, zinc alloy, or a steel material such as stainless steel to improve an effect of the heating wires provided inside or outside the bodies 100.

Hereinafter, embodiments of the method of installing the apparatus for reducing road noise among the apparatus for reducing road noise and the method of installing the same according to the present invention will be described with reference to the accompanying drawings.

The method of installing the apparatus for reducing road noise according to the present invention includes the buried groove forming step of forming the plurality of buried grooves 140 in the direction in which the vehicles travel on the road surface at regular intervals.

An interval between the plurality of buried grooves 140 may be formed such that the interval between the closest communication portions 103 is 40±10 mm when the apparatuses for reducing road noise are seated on the plurality of buried grooves 140, respectively.

Opposite ends of the buried grooves 140 are opened.

The buried grooves 140 may be formed to cross the road surface.

Also, the method of installing the apparatus for reducing road noise according to the present invention includes the arranging step of seating the apparatuses for reducing road noise on the buried grooves 140 such that the distal ends of the communication portions 103 are lower than the road surface and seating the plurality of bodies 100 on the buried grooves 140, respectively, while connecting the bodies 100 to each other.

That is, in more detail, the apparatuses for reducing road noise may be seated on the buried grooves 140 in a scheme in which one of the plurality of bodies 100 is seated on the corresponding buried groove 140 and another body 100 is connected to the previously seated body 100.

Also, after the apparatuses for reducing road noise according to the present invention are formed integrally, the apparatuses may be seated on the buried grooves 140.

When the apparatuses for reducing road noise according to the present invention are seated on the plurality of buried grooves 140, respectively, an interval between the one or more communication portions 103 of the apparatus for reducing road noise, which is seated on the other one buried groove 140 closest to any one of the plurality of communication portions 103 of the apparatus for reducing road noise, which is seated on any one of the plurality of buried grooves 140, is 40±10 mm.

The distal ends of the communication portions 103 may be located to be lower than the road surface by 2 to 3 mm.

The structure in which the distal ends of the communication portions 103 are lower than the road surface corresponds to a protection means for the communication portions 103 and the wheels of the vehicles. When the distal ends are located to be higher than the road surface, the communication portions 103 come directly into contact with the wheels of the vehicles traveling at high speeds. Thus, all the communication portions 103 and the wheels of the vehicles may be damaged, and stability of operation of the vehicles may deteriorate.

Also, when the distal ends of the communication portions 103 have the same height as the road surface, if the road surface is damaged, since the communication portions 103 are exposed to the outside and thus come directly into contact with the wheels of the vehicles, it is preferable that the distal ends of the communication portions 103 are lower than the road surface.

Also, the method of installing the apparatus for reducing road noise according to the present invention includes the injecting step of injecting the fillers 150 into the buried grooves 140 of the arranging step so that the apparatuses for reducing road noise are buried into the buried grooves 140.

The apparatuses for reducing road noise according to the present invention are fixed while being buried in the buried grooves 140 by the fillers 150, and thus do not move even by an external impact.

The apparatuses for reducing road noise according to the present invention are buried in the buried grooves 140 by the fillers 150, but the opposite ends of the buried grooves 140 should not be buried by the fillers 150. Sides and the other sides of the apparatuses for reducing road noise are exposed to the outside at opposite ends of the buried grooves 140.

The fillers 150 may be any one of asphalt, epoxy resin cement, and non-shrinkage mortar, but may be any material that constitutes the road surface.

Also, the method of installing the apparatus for reducing road noise according to the present invention includes the hardening step of hardening the fillers 150.

Hereinafter, embodiments of the apparatus for reducing road noise and the method of installing the same according to the present invention will be described in more detail with reference to the accompanying drawings.

FIG. 1 is a perspective view illustrating a state in which bodies 100 of an apparatus for reducing road noise according to the present invention are connected to each other.

As illustrated in FIG. 1, in the apparatus for reducing road noise, the plurality of bodies 100 is connected to each other by inserting the shim 102 provided at the other end of the another body 100 among the plurality of bodies 100 into the fitting groove 101 formed at the one end of the one body 100.

The communication portions 103 are formed in the bodies 100, and when the plurality of bodies 100 is connected to each other, the plurality of communications 103 should be arranged in a straight line, so that the fitting groove 101 and the shim 102 should be fastened to each other always only at the same position and in the same direction.

Figure 2:
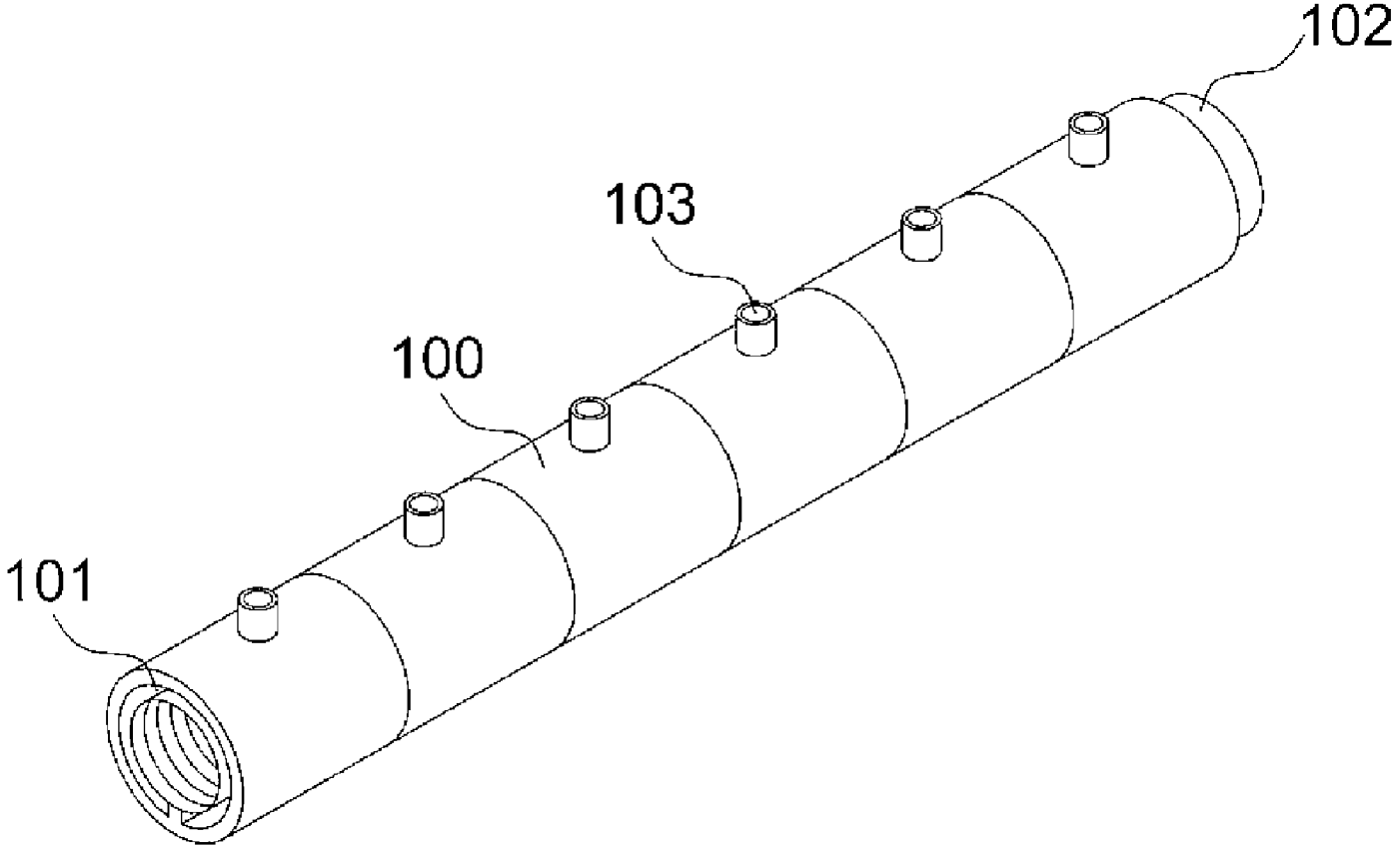
FIG. 2 is an external perspective view illustrating the apparatus for reducing road noise according to the present invention.

FIG. 2 is an external perspective view illustrating the apparatus for reducing road noise according to the present invention.

As illustrated in FIG. 2, the apparatus for reducing road noise according to the present invention is configured by connecting the plurality of bodies 100 to each other, and serves as an apparatus for reducing road noise by absorbing frictional sounds produced as the wheels of the vehicles rub against the road surface.

The plurality of bodies 100 is connected to each other in accordance with the width of a road where the apparatus for reducing road noise according to the present invention is to be installed.

Figure 3:
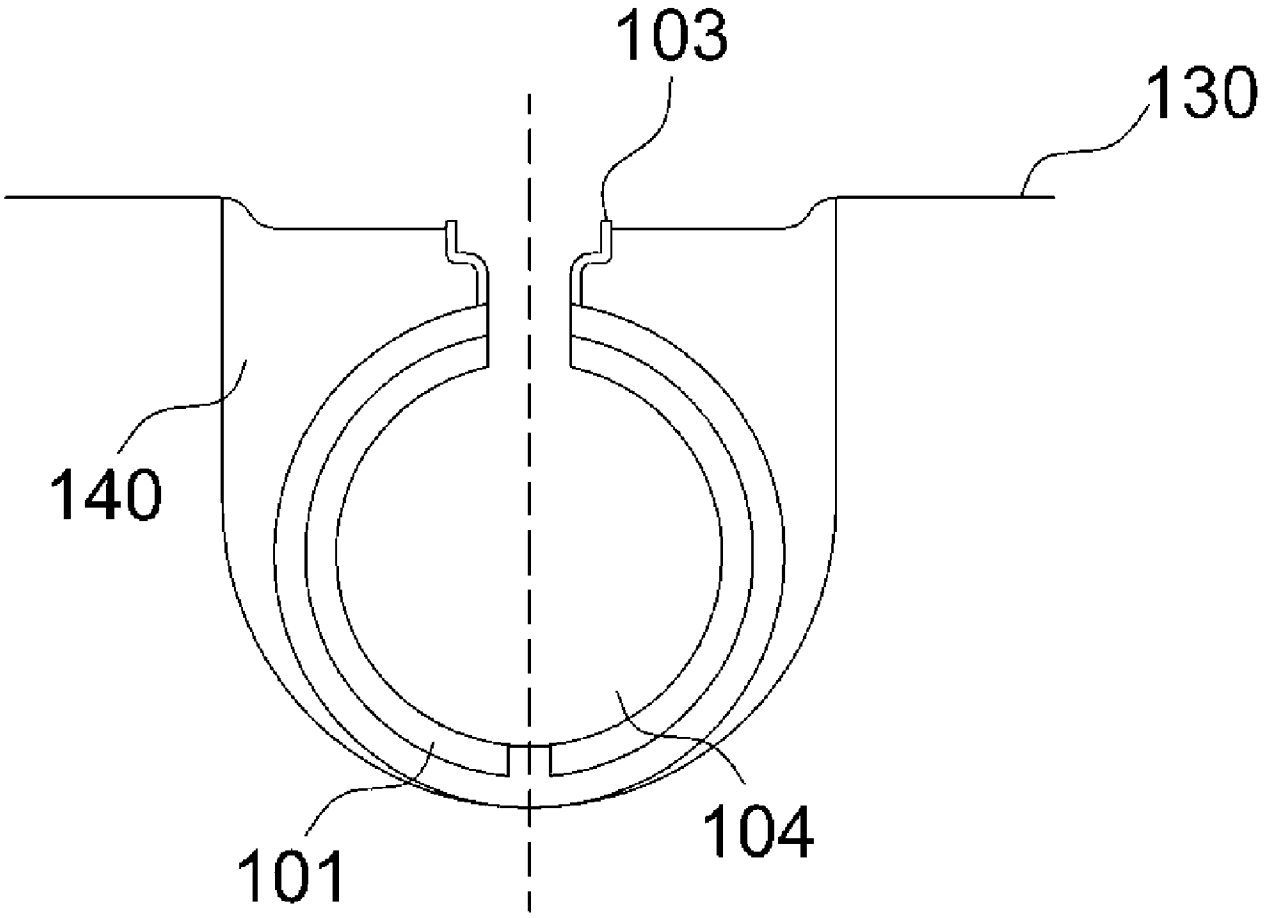
FIG. 3 is a cross-sectional view illustrating a state in which the apparatus for reducing road noise according to the present invention is installed in a road.

FIG. 3 is a cross-sectional view illustrating a state in which the apparatus for reducing road noise according to the present invention is installed in a road.

As illustrated in FIG. 3, the apparatuses for reducing road noise according to the present invention are buried in the buried grooves 140 to serve as noise reduction apparatuses.

The depth of the buried grooves 140 should be formed such that the distal ends of the communication portions 103 may be lower than the road surface when the apparatuses for reducing road noise according to the present invention are seated on the buried grooves 140.

Although the distal ends of the communication portions 103 are located to be higher than a layer formed by the fillers 150, a state in which the distal ends of the communication portions 103 are located to be lower than the road surface by 2 mm to 3 mm is illustrated in FIG. 3.

When the apparatuses for reducing road noise according to the present invention are seated on the buried grooves 140, the fillers 150 are injected into the buried grooves 140 so that the apparatuses for reducing road noise are buried, and the communication portions 103 are not filled with the fillers 150 to allow the hollows 104 formed inside the apparatuses for reducing road noise according to the present invention to communicate with the outside.

Figure 4:
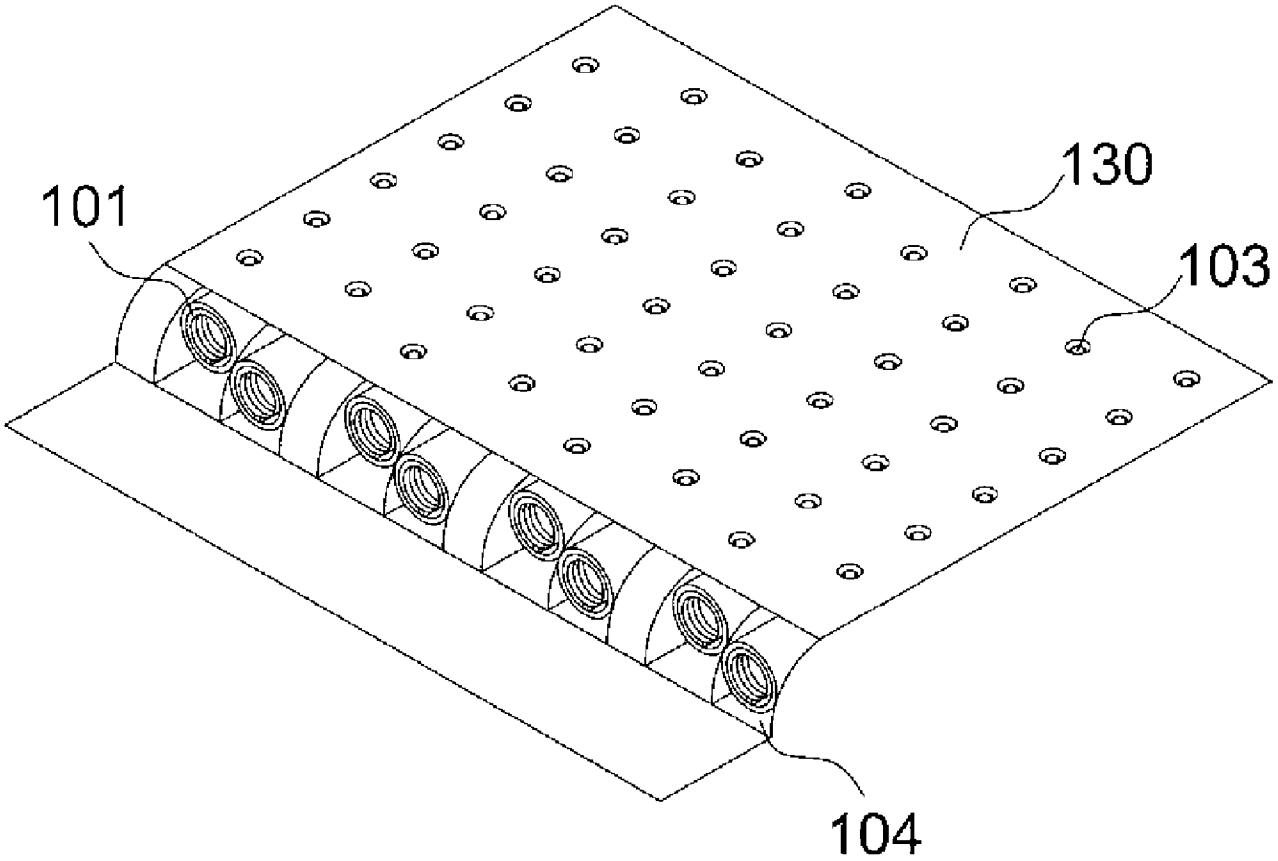
FIG. 4 is an external perspective view illustrating a state in which the apparatus for reducing road noise according to the present invention is installed in the road.

FIG. 4 is an external perspective view illustrating a state in which the apparatus for reducing road noise according to the present invention is installed in the road.

As illustrated in FIG. 4, the apparatuses for reducing road noise according to the present invention are installed to be buried below a road surface 130, and absorb road noise through the communication portions 103 exposed to the outside.

The distal ends of the communication portions 103 are located to be lower than the road surface, and thus the communication portions 103 are not directly in contact with the wheels of the vehicles. Further, even when a groove is generated due to a damage to the road surface, the communication portions 103 are continuously located to be lower than the road surface or a height at which the communication portions 103 protrude above the road surface is minimized.

Since inclined surfaces on which rainwater is to flow are formed at opposite ends of a general road in a longitudinal direction, and opposite ends of the buried grooves 140 formed in the direction in which the vehicles travel on the road surface are opened, holes allowing the buried grooves 140 to communicate with the outside are formed in the inclined surfaces.

Sides and the other sides of the apparatuses for reducing road noise according to the present invention are exposed to the outside through the opposite ends of the buried grooves 140.

Also, in the apparatuses for reducing road noise according to the present invention, the plurality of holes exposed to the road surface by the communication portions 103 may be arranged in a zigzag shape.

Figure 5:
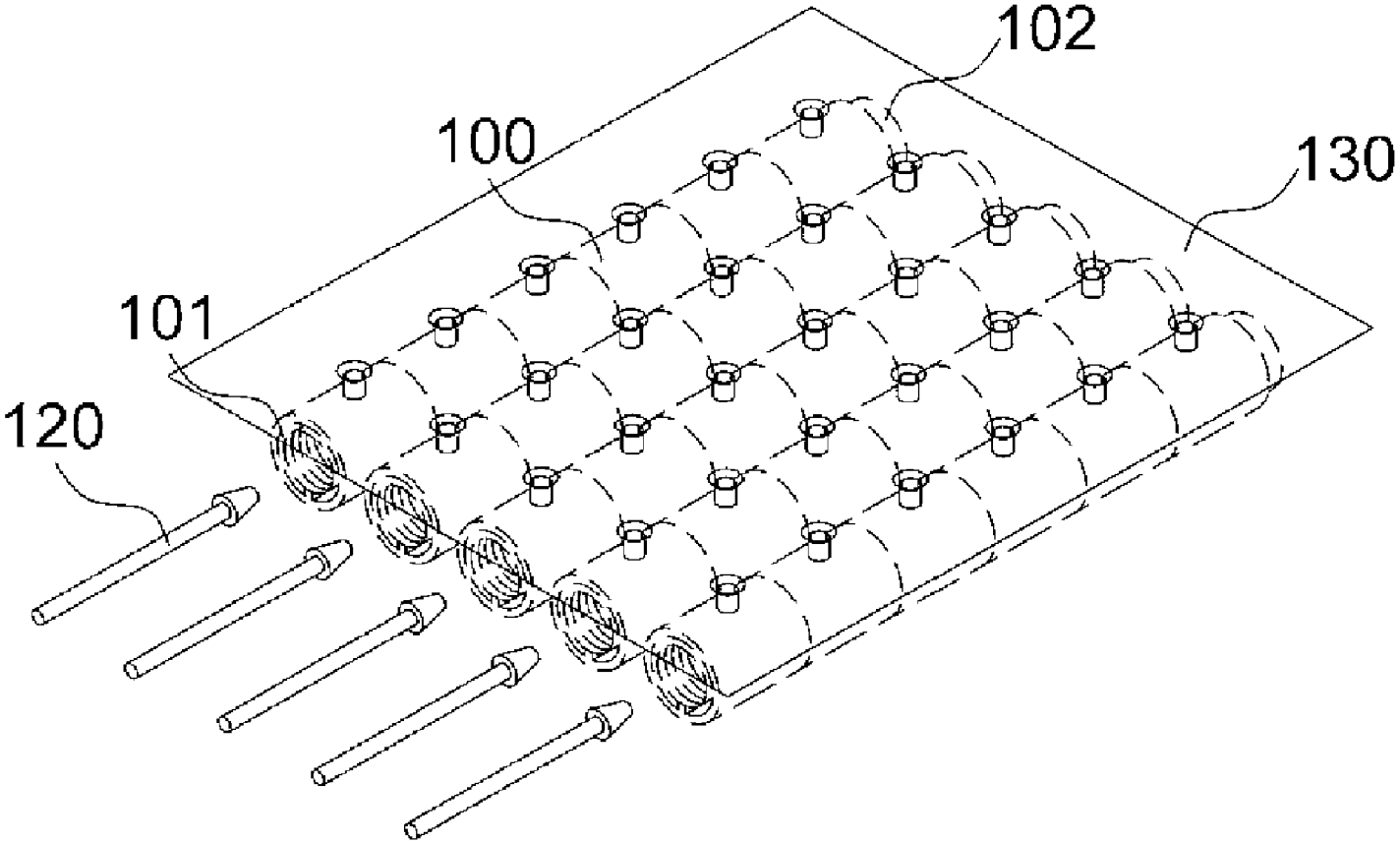
FIG. 5 is a view illustrating an embodiment in which the apparatus for reducing road noise according to the present invention is installed in the road.

FIG. 5 is a view illustrating an embodiment in which the apparatus for reducing road noise according to the present invention is installed in the road.

As illustrated in FIG. 5, the apparatus for reducing road noise according to the present invention has the hollow 104 formed therein to absorb road noise and the communication portion 103 serving as a passage configured to absorb the road noise to the hollow 104.

The communication portions 103 allow the hollows 104 to communicate with the outside, and foreign matters such as dust as well as the road noise are introduced into the hollows 104 through the communication portions 103.

When the foreign matters are stacked inside the hollows 104, the volume of the hollows 104 is reduced, leading to a reduction in the road noise absorbing effect. Thus, an apparatus for periodically removing the foreign matters is required.

In order to solve the above-described problems, compressed air or water is injected into the hollows 104 through sides of the apparatuses for reducing road noise according to the present invention, which are exposed to the outside, to discharge the foreign matters inside the hollows 104 to the outside through the other sides of the apparatuses for reducing road noise according to the present invention.

Also, in order to solve a phenomenon in which the rainwater introduced into the hollows 104 is frozen, hot water may be injected into the hollows 104, the compressed air may be injected to remove moisture, and the heating wires are provided inside or outside the bodies to provide heat.

Figure 6:
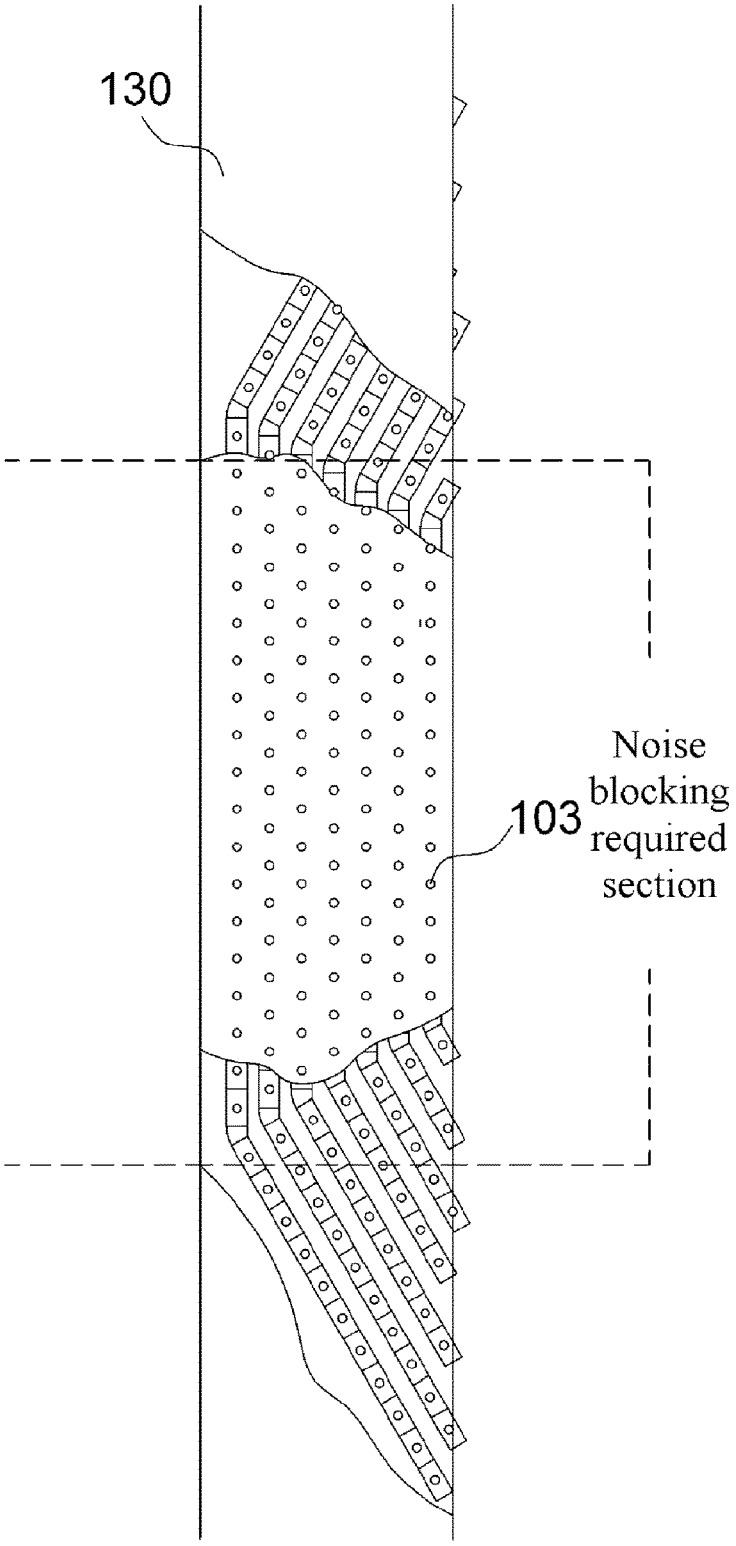
FIG. 6 is a cutaway view illustrating the embodiment in which the apparatus for reducing road noise according to the present invention is installed in the road.

FIG. 6 is a cutaway view illustrating the embodiment in which the apparatus for reducing road noise according to the present invention is installed in the road.

As illustrated in FIG. 6, the apparatuses for reducing road noise according to the present invention are buried and installed only in a section where blocking of road noise is required along the direction in which the vehicles travel on the road surface 130. When the apparatuses are installed to extend to a range beyond the section where the blocking of the road noise is required to discharge the rainwater, the foreign matters, and the like flowing thereinto to the outside, the extending portion may be buried such that the communication portions 103 are not exposed to the road surface 130.

The above-described embodiments are provided as examples such that the technical spirit of the present invention may be sufficiently transferred to those skilled in the art to which the present invention pertains, and the present invention is not limited to the above-described embodiments, and may be specified in other forms.

A part unrelated to the description is omitted to clearly describe the present invention, and in the drawings, the widths, the lengths, the thicknesses, and the like of components may be exaggeratedly or reducedly expressed for convenience.

Also, throughout the specification, the same reference numerals are designated by the same components.

The invention claimed is:

1. An apparatus for reducing road noise, the apparatus being seated on a plurality of buried grooves spaced at regular intervals and in a direction in which vehicles travel on a road surface, the apparatus comprising:

pipe-shaped bodies each having a hollow formed in the corresponding body to pass through a part of one end and a part of the other end of the body, a fitting groove formed toward an inside of the one end, a shim protruding outward from the other end, and a communication portion formed at a side portion of the body to allow the hollow to communicate with the outside, the communication portion comprising a cylindrical shape having a diameter ranging from 4 mm to 10 mm, wherein distal ends of the communication portions open to an outside comprise filtration films, and wherein the distal ends of the communication portions are positioned 2 mm to 3 mm lower than the road surface;

wherein the plurality of bodies are connected to each other such that the shim is fastened to the corresponding fitting groove, and wherein an interval between the communication portions, which are configured by connecting the plurality of bodies to each other, is 40+/−10 mm;

wherein a space between the buried grooves and the apparatus for reducing road noise comprises a filler material adapted to reduce road noise, and wherein the communication portions are not filled with filler material, and wherein a heating wire is provided inside and/or outside the body.

2. A method of installing an apparatus for reducing road noise, the method comprising:

a buried groove forming step of forming a plurality of buried grooves in a direction in which vehicles travel on a road surface at regular intervals;

an arranging step of seating the apparatus of claim 1 on the buried grooves such that distal ends of the communication portions are lower than the road surface, and seating the plurality of bodies on the buried grooves, respectively, while connecting the bodies to each other;

an injecting step of inserting fillers into the buried grooves of the arranging step so that the apparatuses for reducing road noise are buried in the buried grooves; and a hardening step of hardening the fillers, wherein an interval between the plurality of buried grooves is formed such that an interval between the closest communication portions is 40±10 mm when the apparatuses for reducing road noise are seated on the plurality of buried grooves, respectively, and wherein the distal ends of the communication portions are located to be lower than the road surface by 2 mm to 3 mm.

* * * * *